US009096967B2

(12) United States Patent
Batur et al.

(10) Patent No.: US 9,096,967 B2
(45) Date of Patent: Aug. 4, 2015

(54) WASHER/DRYER COMPRISING A LOCK

(75) Inventors: Alper Batur, Istanbul (TR); Dogan Demirhan, Istanbul (TR); Veysel Ertan Cetinkaya, Istanbul (TR); Canyigit Atay, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 40 days.

(21) Appl. No.: 13/997,648

(22) PCT Filed: Dec. 6, 2011

(86) PCT No.: PCT/EP2011/071857

§ 371 (c)(1),
(2), (4) Date: Sep. 9, 2013

(87) PCT Pub. No.: WO2012/084483

PCT Pub. Date: Jun. 28, 2012

(65) Prior Publication Data

US 2014/0001934 A1 Jan. 2, 2014

(30) Foreign Application Priority Data

Dec. 24, 2010 (TR) ..... a 2010 10879

(51) Int. Cl.

| | |
|---|---|
| ***A47B 77/06*** | (2006.01) |
| ***D06F 39/14*** | (2006.01) |
| ***D06F 39/12*** | (2006.01) |

(52) U.S. Cl.

CPC ..... *D06F 39/14* (2013.01); *D06F 39/12* (2013.01)

(58) Field of Classification Search

CPC . A47B 2220/03; A47L 15/4246; D06F 58/04; D06F 58/20

USPC ..... 312/228, 405; 34/603

See application file for complete search history.

(56) References Cited

U.S. PATENT DOCUMENTS

| | | | | | |
|---|---|---|---|---|---|
| 4,408,432 | A | * | 10/1983 | Carter et al. | 52/718.04 |
| 4,745,656 | A | * | 5/1988 | Revlett | 16/412 |
| 5,118,151 | A | * | 6/1992 | Nicholas et al. | 292/341.19 |
| 5,303,445 | A | * | 4/1994 | Meyers | 15/235.4 |
| 5,402,553 | A | * | 4/1995 | Goetz et al. | 16/413 |
| 6,609,274 | B2 | * | 8/2003 | Christensen et al. | 16/412 |
| 6,954,992 | B2 | * | 10/2005 | Hwang | 34/108 |
| 7,000,959 | B2 | * | 2/2006 | Sanders | 292/340 |
| 7,549,713 | B2 | * | 6/2009 | Gose et al. | 312/405 |

(Continued)

FOREIGN PATENT DOCUMENTS

| | | | | | |
|---|---|---|---|---|---|
| WO | WO 2008133392 | A1 | * | 11/2008 | E05B 47/00 |
| WO | 2010092529 | A1 | | 8/2010 | |

OTHER PUBLICATIONS

International Search Report for PCT/EP2011/071857.

*Primary Examiner* — Hanh V Tran
(74) *Attorney, Agent, or Firm* — Venjuris, P.C.

(57) ABSTRACT

The present invention relates to a washer/dryer (1) comprising two side walls (2) closing the volume from sides wherein the drum, in which the laundry is placed, and other elements are located, a front wall (3) closing the said volume from the front, an opening (4) which is disposed on the front wall (3) and enables the laundry to be placed in the drum, a lid (5) covering the opening (4), a lock (6) disposed on the front wall (3), a tenon (7) which is disposed on the lid (5) and provides the lid (5) to remain in the closed position by being placed into the lock (6) and a hole (8) disposed on the front wall (3), behind which the lock (6) is placed and which enables the tenon (7) to reach the lock (6).

19 Claims, 7 Drawing Sheets

(56) References Cited

U.S. PATENT DOCUMENTS

Figure 1:
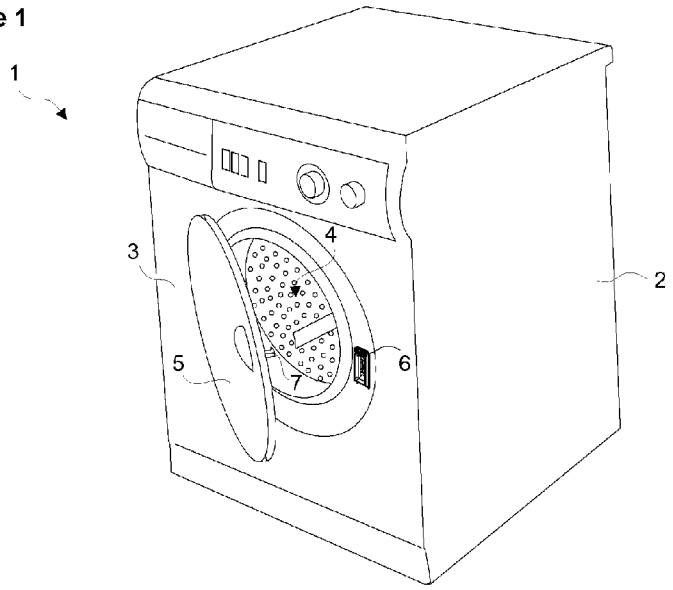

2003/0079313 A1* 5/2003 Pohl et al. ..... 16/436
2006/0059711 A1* 3/2006 Kim et al. ..... 34/603
2008/0231061 A1* 9/2008 Rocchitelli ..... 292/303

* cited by examiner

WASHER/DRYER COMPRISING A LOCK

The present invention relates to a washer/dryer that comprises a lock.

In washers/dryers, the lid used for loading and unloading the laundry is provided to be kept in the closed position by means of a lock. Locking is realized by the placement of a tenon generally disposed on the lid into a lock disposed on the front wall of the body.

In the state of the art, the members that form the lock are in grouped state. The lock group is realized by passing the lock port into which the tenon enters entirely to the front side from the rear side of the front wall, through an opening disposed on the front wall and by fixing the lock port in this position.

The fixation process is generally performed by means of screws and this causes an increase in terms of both the material cost and the labor cost. In the state of the art, various embodiments are developed related to the mounting of the lock group to the front wall without screws.

In the state of the art embodiment, the European Patent Application No. EP1681386, a washer/dryer comprising a lock group which is mounted onto the front wall in a telescopic manner by being rotated and slid after being inserted from one side is explained.

Another state of the art embodiment is explained in the German Patent Application No. DE38106476. The washer/dryer explained in this application has a body that is assembled by mounting the protrusions disposed on the base into the housings disposed on the side walls.

In these state of the art embodiments, the opening disposed on the front wall should be of the dimensions of the lock port. Any change in the configuration of the port requires the front wall also to be changed.

The aim of the present invention is the realization of a washer/dryer that can be easily mounted.

In the washer/dryer realized in order to attain the aim of the present invention and explicated in the claims, the lock comprises a body that remains at the rear side of the front wall. An extension, which extends towards the front of the front wall through the hole on the front wall, is disposed on the body. The lock is provided to be fixed to the front wall by means of a connection member mounted to the extension from the front of the front wall. When the lock is mounted to the front wall, the body remains behind the front wall and the connection member in front thereof. Thus, the lock is provided to be easily mounted to the front wall.

A port is disposed on the connection member and a housing, which is aligned with the port when the connection member is mounted onto the extension, is disposed on the extension. The tenon is placed into the lock by passing through the port and the housing.

In an embodiment of the present invention, the connection member is mounted by being slid by the placement of the slides disposed on the edges of the connection member into the rails disposed on the edges of the extension. In a variation of this embodiment, an inlet, which enables the slides to be inserted onto the rail, is provided at the lower end of the slides.

In an embodiment of the present invention, a detent means is disposed on the body. While the connection member is mounted onto the extension by being slid, the detent means is opened by being pushed by a pushing surface disposed on the body. When the sliding process is continued afterwards, the detent means leaps over the pushing surface and the detent means, which is disposed aligned with the recess, on the body just behind the pushing surface in the sliding direction, becomes free and is placed into the recess. After being placed into the recess, the detent means prevents the movement of the connection member by bearing against the recess walls.

In an embodiment of the present invention, the connection member is also wider than the hole and the extension so as to close the hole and the extension and hence to provide an aesthetic appearance at the side visible to the user.

In an embodiment of the present invention, the lock comprises a latch which provides locking and a spring that the latch compresses by its movement. The latch is rotatably mounted to the body and disposed behind the housing.

By means of the present invention, in the washer/dryer the lock is provided to be easily mounted to the front wall.

The model embodiments related to a washer/dryer realized in order to attain the aim of the present invention are illustrated in the attached figures, where:

FIG. 1—is the perspective view of a washer/dryer.

Figure 2:
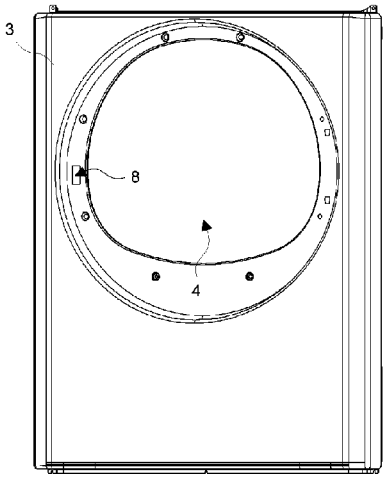

FIG. 2—is the perspective view of the front wall.

Figure 3:
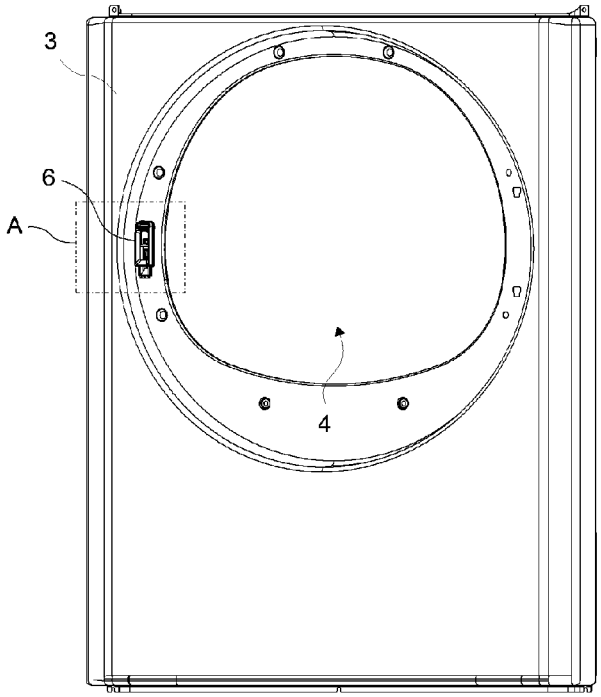

FIG. 3—is the perspective view of the front wall while the connection member is being mounted to the extension.

Figure 4:
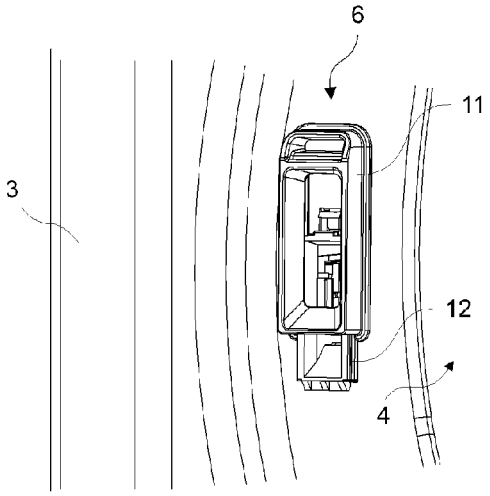

FIG. 4—is the view of detail A in FIG. 2.

Figure 5:
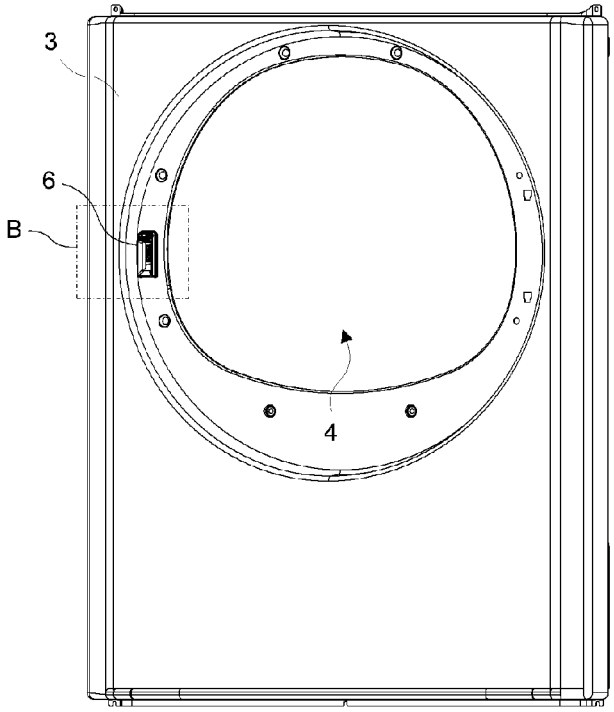

FIG. 5—is the perspective view of the front wall when the connection member is mounted to the extension.

Figure 6:
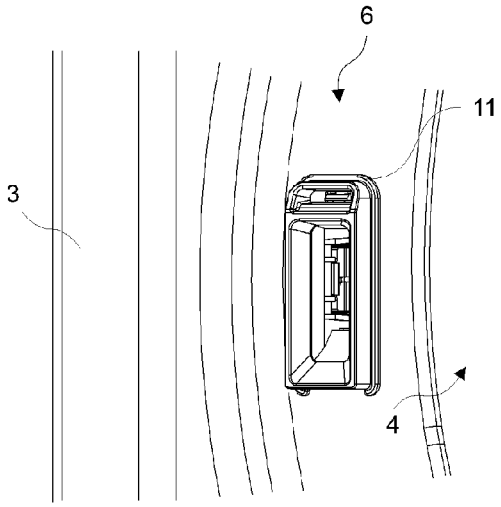

FIG. 6—is the view of detail B in FIG. 5.

Figure 7:
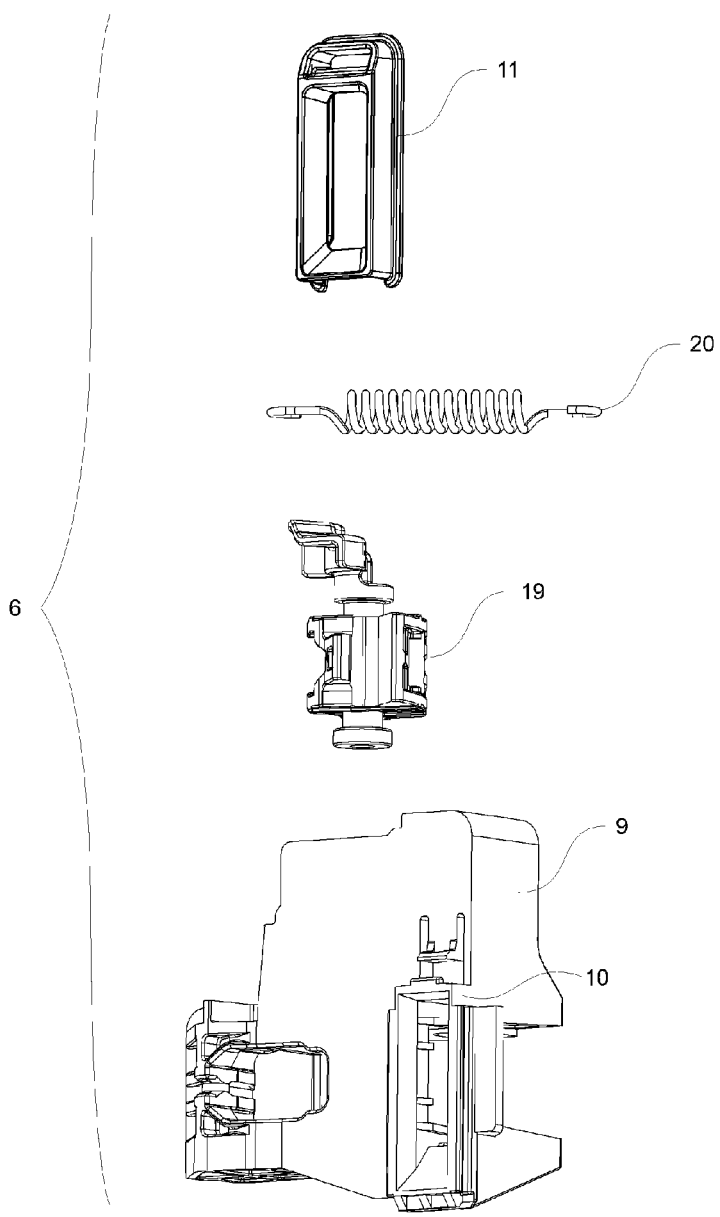

FIG. 7—is the exploded view of the lock.

Figure 8:
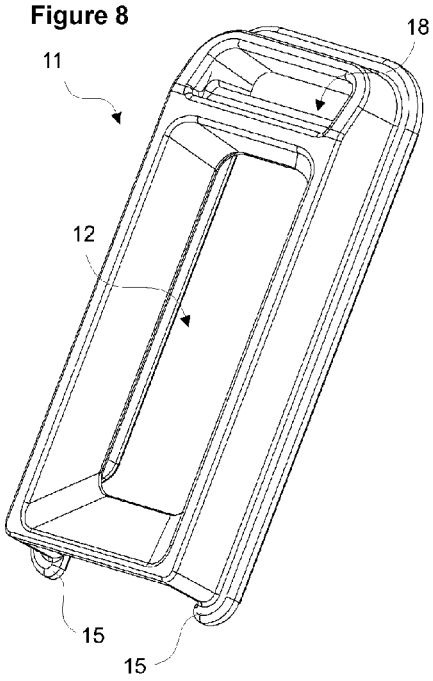

FIG. 8—is the front perspective view of the connection member.

Figure 9:
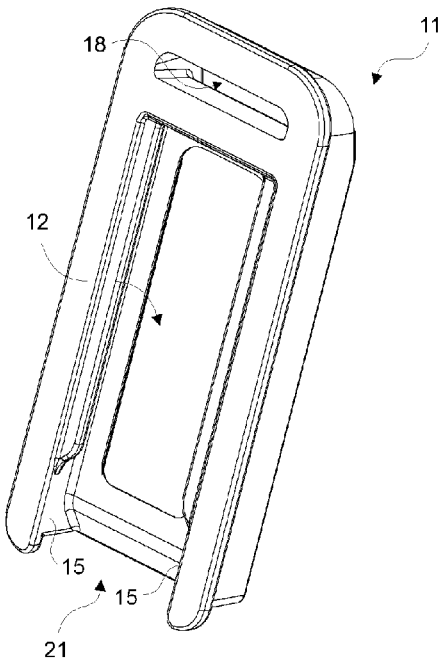

FIG. 9—is the rear perspective view of the connection member.

Figure 10:
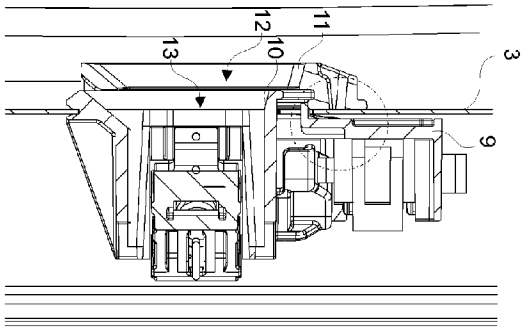

FIG. 10—is the sideways cross-sectional view of the front wall while the connection member is being mounted to the extension.

Figure 11:
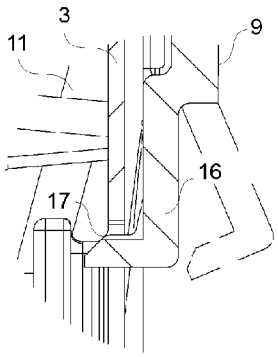

FIG. 11—is the view of detail C in FIG. 9.

Figure 12:
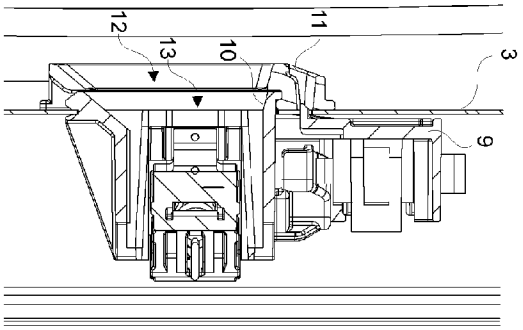

FIG. 12—is the sideways cross-sectional view of the front wall when the connection member is mounted to the extension.

Figure 13:
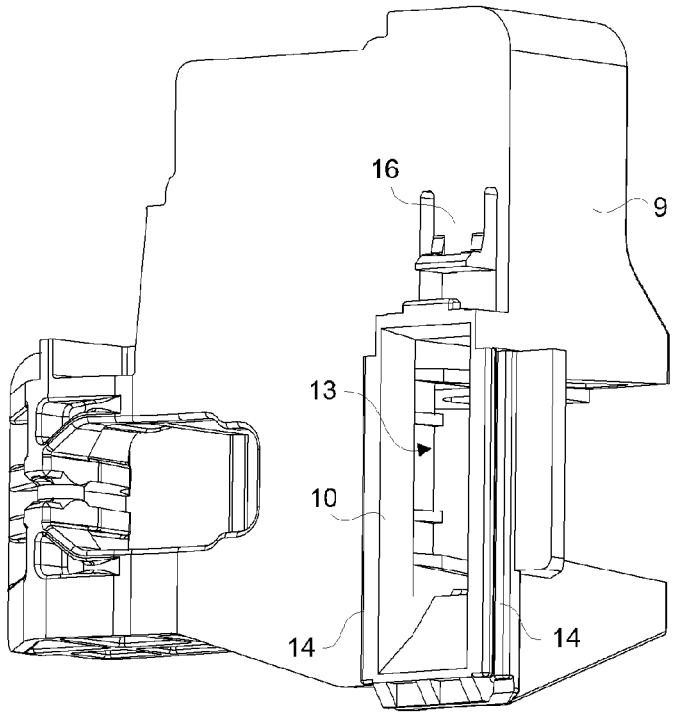

FIG. 13—is the perspective view of the body and the extension.

Figure 14:
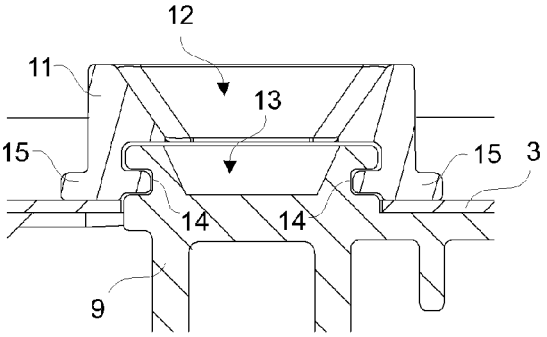

FIG. 14—is the top cross-sectional view of the front wall when the connection member is mounted to the extension.

The elements illustrated in the figures are numbered as follows:

1. Washer/dryer
2. Side wall
3. Front wall
4. Opening
5. Lid
6. Lock
7. Tenon
8. Hole
9. Body
10. Extension
11. Connection member
12. Port
13. Housing
14. Rail
15. Slide
16. Detent means
17. Pushing surface
18. Recess
19. Latch
20. Spring
21. Inlet The washer/dryer (1) comprises two side walls (2) closing the volume from sides wherein the drum, in which the laundry is placed, and other elements are located, a front wall (3) closing the said volume from the front, an opening (4) which is disposed on the front wall (3) and enables the laundry to be placed in the drum, a lid (5) covering the opening (4), a lock (6) disposed on the front wall (3), a tenon (7) which is disposed on the lid (5) and provides the lid (5) to remain in the closed position by being placed into the lock (6) and a hole (8) disposed on the front wall (3), behind which the lock (6) is placed and which enables the tenon (7) to reach the lock (6).

In the washer/dryer (1) of the present invention, the lock (6) comprises a body (9) that remains at the rear side of the front wall (3), an extension (10) which is disposed on the body (9) and passes to the front of the front wall (3) through the hole (8) and a connection member (11) mounted onto the extension (10) from the front side of the front wall (3) and which provides the lock (6) to be fixed to the front wall (3).

When the lock (6) is fixed to the front wall (3) by means of the connection member (11), the front wall (3) remains between the body (9) and the connection member (11). Thus, the lock (6) is provided to be easily mounted to the front wall (3) without using an additional fixing element such as screw, etc.

The connection member (11) comprises a port (12) which enables the tenon (7) to be placed into the lock (6) by passing therethrough. The extension (10) comprises a housing (13) which is aligned with the port (12) and which enables the tenon (7) to be placed into the lock (6) by passing therethrough. Thus, while fixing the lock (6) to the front wall (3) by being mounted onto the extension (10), the connection member (11) does not prevent the tenon (7) from being placed into the lock (6).

In an embodiment of the present invention, the extension (10) comprises a rail (14) on each of the two sides thereof. In this embodiment, the connection member (11) comprises two slides (15) which provide the connection member (11) to be mounted to the rails (14) by being slid. Thus, the connection member (11) is provided to be easily mounted onto the extension (10).

In a variation of this embodiment, the connection member (11) furthermore comprises an inlet (21) at the lower end thereof which provides the slides (15) to be mounted to the rails (14). After the body (9) is placed behind the front wall (3) such that the extension (10) extends forwards from the hole (8), the slides (15) that pass through the inlet (21) are mounted to the rails (14). The connection member (11) is inserted onto the extension (10) by sliding the slides (15) from the top downwards inside the rails (14). Thus, the lock (6) is provided to be easily mounted to the front wall (3) with a simple sliding motion.

In an embodiment of the present invention, the body (9) comprises a detent means (16) configured so as to stretch to one side and the connection member (11) comprises a pushing surface (17) which provides the detent means (16) to be opened by pressing on it in the movement direction while the connection member (11) is being mounted onto the extension (10) and a recess (18) disposed behind the pushing surface (17) in the movement direction and into which the detent means (16) is placed after becoming free by being released from the pushing surface (17). Thus, the connection member (11) is prevented from being easily dislodged after being mounted onto the extension (10).

In an embodiment of the present invention, the front surface of the connection member (11) is wider than the hole (8) and the extension (10). Thus, the hole (8) and the extension (10) are prevented from being seen by the user and the visual feature of the front wall (3) is improved.

In an embodiment of the present study, the lock (6) comprises a latch (19) which is rotatably mounted to the body (9), disposed behind the housing (13), rotated by the tenon (7) by pushing while being placed into the lock (6) and which provides the tenon (7) to be kept in the lock (6) and a spring (20) one end of which is mounted to the body (9) and the other end of which is mounted to the latch (19), compressed by the rotation of the latch (19) and which provides the latch (19) to resume its former position by transmitting the energy it stores to the latch (19) when the latch (19) becomes free.

By means of the present invention, the lock (6) is provided to be easily fixed to the front wall (3) without requiring an additional fixing member and the portion of the lock (6) which is seen by the user is provided to be visually improved.

It is to be understood that the present invention is not limited to the embodiments disclosed above and a person skilled in the art can easily introduce different embodiments. These should be considered within the scope of the protection postulated by the claims of the present invention.

The invention claimed is:

1. A washer/dryer (1) comprising two side walls (2) closing the volume from sides wherein the drum, in which the laundry is placed, and other machine elements are located, a front wall (3) closing the said volume from the front, an opening (4) which is disposed on the front wall (3) and enables the laundry to be placed in the drum, a lid (5) covering the opening (4), a lock (6) disposed on the front wall (3), a tenon (7) which is disposed on the lid (5) and provides the lid (5) to remain in the closed position by being placed into the lock (6) and a hole (8) disposed on the front wall (3), behind which the lock (6) is placed and which enables the tenon (7) to reach the lock (6), wherein the lock (6) includes a body (9) that remains at the rear side of the front wall (3), an extension (10) which is disposed on the body (9) and passes to the front of the front wall (3) through the hole (8) and a connection member (11) separate from and mounted onto the extension (10) from the front side of the front wall (3) and which provides the lock (6) to be fixed to the front wall (3).

2. The washer/dryer (1) as in claim 1, wherein the lock (6) which is fixed to the front wall (3) by means of the connection member (11) such that the front wall (3) remains between the body (9) and the connection member (11).

3. The washer/dryer (1) as in claim 1, wherein the connection member (11) comprising a port (12) which enables the tenon (7) to be placed into the lock (6) by passing therethrough and a housing (13) aligned with the port (12) and which enables the tenon (7) to be placed into the lock (6) by passing therethrough.

4. The washer/dryer (1) as in claim 1, wherein the extension (10) comprising a rail (14) on each of the two sides thereof and the connection member (11) comprising two slides (15) which provides the connection member (11) to be mounted to the rails (14) by being slid.

5. The washer/dryer (1) as in claim 4, wherein the connection member (11) comprising an inlet (21) disposed at the lower end thereof and which enables the slides (15) to be mounted to the rails (14).

6. The washer/dryer as in claim 1 wherein the body (9) comprising a detent means (16) configured so as to stretch to one side and the connection member (11) comprising a pushing surface (17) which provides the detent means (16) to be opened by pressing on it in the movement direction while the connection member (11) is being mounted onto the extension (10) and a recess (18) disposed behind the pushing surface (17) in the movement direction and into which the detent means (16) is placed after becoming free by being released from the pushing surface (17).

7. The washer/dryer as in claim 1, wherein the connection member (11), the front surface of which is wider than the hole (8) and the extension (10).

8. The washer/dryer as in claim 1, wherein the lock (6) comprising a latch (19) which is rotatably mounted to the body (9), disposed behind the housing (13), rotated by the tenon (7) by pushing while being placed into the lock (6) and which provides the tenon (7) to be kept in the lock (6) and a spring (20) one end of which is mounted to the body (9) and the other end of which is mounted to the latch (19), compressed by the rotation of the latch (19) and which provides the latch (19) to resume its former position by transmitting the energy it stores to the latch (19) when the latch (19) becomes free.

9. The washer/dryer (1) as in claim 2, wherein the connection member (11) comprising a port (12) which enables the tenon (7) to be placed into the lock (6) by passing therethrough and a housing (13) aligned with the port (12) and which enables the tenon (7) to be placed into the lock (6) by passing therethrough.

10. The washer/dryer as in claim 2, wherein the extension (10) comprising a rail (14) on each of the two sides thereof and the connection member (11) comprising two slides (15) which provides the connection member (11) to be mounted to the rails (14) by being slid.

11. The washer/dryer (1) as in claim 10, wherein the connection member (11) comprising an inlet (21) disposed at the lower end thereof and which enables the slides (15) to be mounted to the rails (14).

12. The washer/dryer as in claim 2, wherein the body (9) comprising a detent means (16) configured so as to stretch to one side and the connection member (11) comprising a pushing surface (17) which provides the detent means (16) to be opened by pressing on it in the movement direction while the connection member (11) is being mounted onto the extension (10) and a recess (18) disposed behind the pushing surface (17) in the movement direction and into which the detent means (16) is placed after becoming free by being released from the pushing surface (17).

13. The washer/dryer as in claim 2, wherein the connection member (11), the front surface of which is wider than the hole (8) and the extension (10).

14. The washer/dryer as in claim 2, wherein the lock (6) comprising a latch (19) which is rotatably mounted to the body (9), disposed behind the housing (13), rotated by the tenon (7) by pushing while being placed into the lock (6) and which provides the tenon (7) to be kept in the lock (6) and a spring (20) one end of which is mounted to the body (9) and the other end of which is mounted to the latch (19), compressed by the rotation of the latch (19) and which provides the latch (19) to resume its former position by transmitting the energy it stores to the latch (19) when the latch (19) becomes free.

15. The washer/dryer as in claim 9, wherein the extension (10) comprising a rail (14) on each of the two sides thereof and the connection member (11) comprising two slides (15) which provides the connection member (11) to be mounted to the rails (14) by being slid.

16. The washer/dryer (1) as in claim 15, wherein the connection member (11) comprising an inlet (21) disposed at the lower end thereof and which enables the slides (15) to be mounted to the rails (14).

17. The washer/dryer as in claim 16, wherein the body (9) comprising a detent means (16) configured so as to stretch to one side and the connection member (11) comprising a pushing surface (17) which provides the detent means (16) to be opened by pressing on it in the movement direction while the connection member (11) is being mounted onto the extension (10) and a recess (18) disposed behind the pushing surface (17) in the movement direction and into which the detent means (16) is placed after becoming free by being released from the pushing surface (17).

18. The washer/dryer as in claim 17, wherein the connection member (11), the front surface of which is wider than the hole (8) and the extension (10).

19. The washer/dryer as in claim 18, wherein the lock (6) comprising a latch (19) which is rotatably mounted to the body (9), disposed behind the housing (13), rotated by the tenon (7) by pushing while being placed into the lock (6) and which provides the tenon (7) to be kept in the lock (6) and a spring (20) one end of which is mounted to the body (9) and the other end of which is mounted to the latch (19), compressed by the rotation of the latch (19) and which provides the latch (19) to resume its former position by transmitting the energy it stores to the latch (19) when the latch (19) becomes free.

* * * * *